US006186395B1

(12) United States Patent
Kennett

(10) Patent No.: US 6,186,395 B1
(45) Date of Patent: Feb. 13, 2001

(54) FOOD OR DRINK CONTAINER

(75) Inventor: William Beverley Kennett, Fife (GB)

(73) Assignee: Peter Anthony Welsford, Berkshire (GB); a part interest ( * ) Notice: Under 35 U.S.C. 154(b), the term of this patent shall be extended for 0 days.

(21) Appl. No.: 08/776,535

(22) PCT Filed: Jul. 13, 1995

(86) PCT No.: PCT/GB95/01813

§ 371 Date: Apr. 30, 1997

§ 102(e) Date: Apr. 30, 1997

(87) PCT Pub. No.: WO96/03906

PCT Pub. Date: Feb. 15, 1996

(30) Foreign Application Priority Data

Aug. 2, 1994 (GB) ..... 9415545
May 16, 1995 (GB) ..... 9509860

(51) Int. Cl.[7] ..... B65D 1/26

(52) U.S. Cl. ..... 229/402; 220/757; 206/217; 206/515; 206/519

(58) Field of Search ..... 229/402; 220/757; 206/217, 519, 515

(56) References Cited

U.S. PATENT DOCUMENTS 2,775,382 * 12/1956 Kayat ..... 229/402
2,937,783 5/1960 Press et al. .
4,049,187 * 9/1977 Florian ..... 220/757
5,174,965 * 12/1992 Jones et al. ..... 229/402

FOREIGN PATENT DOCUMENTS 187 860 11/1922 (GB) .
487264 * 6/1938 (GB) ..... 229/402
881203 * 11/1961 (GB) ..... 229/402
401 107 1/1993 (GB) .

* cited by examiner

*Primary Examiner*—Joseph M. Moy
(74) *Attorney, Agent, or Firm*—Shoemaker & Mattare

(57) ABSTRACT

A food or drink container more particularly with an integrally formed handle or handles which can be assembled from a stacking position to a position of use is described. In one construction the container (1) comprises a cup-shaped part (2) which tapers from an upper rim (3) to a cone or round shaped base (4) terminating in a base rim (5) with a cutaway portion (6) forming an angled edge (7). Extending radially from the upper rim (3) is a winged projection (8) the center part (9) of which is horizontal to the upper rim. Two fold lines (10) are formed in the part (9) to facilitate the folding of two wings (12*a,* 12*b*) downwards as shown by arrows "A". The edge walls (13) of the wings (12*a,* 12*b*) engage and abut each other in their fully folded down position to form a resilient handle.

5 Claims, 4 Drawing Sheets

FOOD OR DRINK CONTAINER

This invention relates to a food or drink container and more particularly to a container with an integrally formed handle or handles which can be assembled from a stacking position to a position of use.

Stackable one-piece containers with an integrally formed handle are known, but these are relatively complex in their construction and their method of assembly and have the disadvantage that the handle may be unstable when the container is filled with hot food or drink.

An aim of the present invention is to provide an improved food or drink container which overcomes the above disadvantages.

According to the present invention there is provided a food or drink container comprising a cup-shaped part formed with at least one integral winged projection which can be folded from a stacking position for the container into a handle to hold and support the cup-shaped part wherein the winged projection has means to lock the free end of the handle to the cup-shaped part.

Preferably, the container is made from a plastics material by an injection moulding process.

Conveniently, the winged projection extends radially from the rim of the cup-shaped part to facilitate nesting of a plurality of the containers.

In an alternative construction the cup-shaped part has two winged projections extending radially from opposite sides of the rim of the cup-shaped parts.

The means to lock the handle is preferably an angle-shaped part with a series of parallel lateral grooves which clip onto a shoulder of the base of the cup-shaped part of the container.

The shape of the winged projection may take the form of a hollow tube section having a rectangular, round oval or octagonal cross-section to simulate a conventional cup handle.

Preferably, the winged projections have locking means to secure the winged projections together.

In a preferred construction the locking means is a pin on one winged projection engaging a hole in the other winged projection.

Embodiments of the stackable container will now be described by way of example only, with reference to the accompanying drawings, in which:

FIG. 9*a* is a sectional detail of the locking means in the unlocked position while

Figure 1:
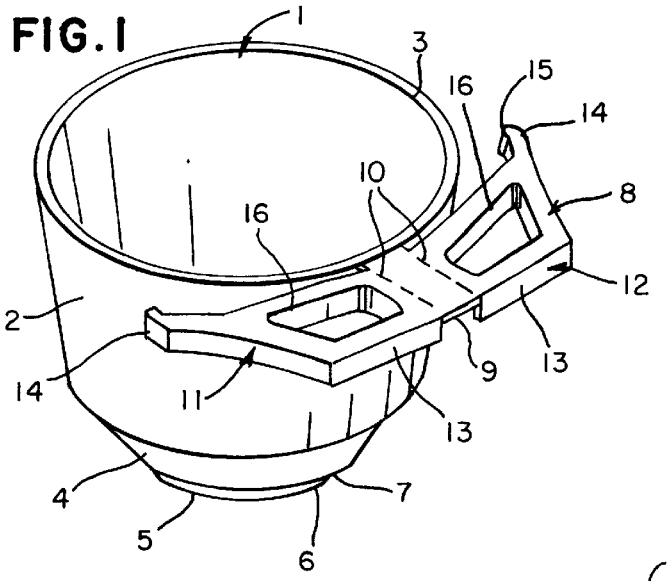
FIG. 1 is a perspective view of a first embodiment of a container with a single winged projection in the horizontal position, for stacking.

The container may be used e.g. as a cup for containing drinks or as a bowl for hot food such as soup or rice.

Each container 1 has a cup-shaped part 2 which tapers from an upper rim 3 to a cone or round shaped base 4 terminating in a base rim 5 with a cutaway portion 6 forming an angled edge 7.

Extending radially from the upper rim 3 is a winged projection 8 the centre part 9 of which is horizontal to the upper rim. Two fold lines 10 are formed in the part 9 to facilitate the folding of the two wings 12*a* and 12*b* downwards as shown by the arrows 'A' in FIG. 2.

Figure 3:
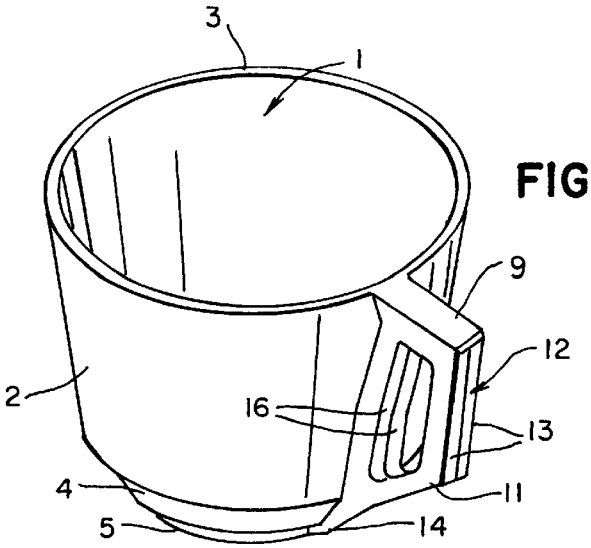
FIG. 3 is a perspective view of the container of FIGS. 1 and 2 with the winged projection folded to form a handle.

The edge walls 13 of the wings 12*a* and 12*b* engage and abut each other in their fully folded down position to form a resilient handle as shown in FIG. 3.

The free ends of the two wings 12*a* and 12*b* have angle shaped abutments 14 with transverse grooves 15 on their inner edges, which in the assembled handle engage an angled surface 7 formed by the base of the cup 2. The engagement of the abutments 14 with the angled surface 7 locks the handle to the lower edge of the cup 2 to form a stable handle for the container.

Figure 4:
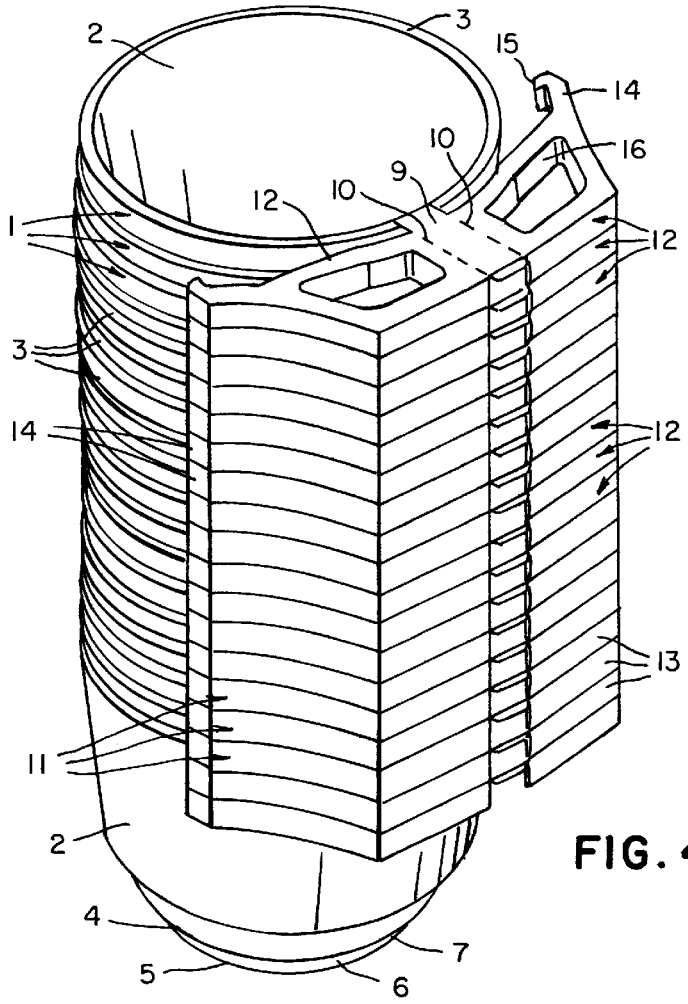
FIG. 4 is a perspective view of a stack of nested containers, according to the invention, each container having a single handle.

As shown in FIG. 4 a plurality of containers 1 are nested in a stack to reduce their volume when stored for transport such as in aircraft or when located in a drink or food dispensing machine the containers 1 nest closely with their winged projection 8 lying flush with the winged projection of an adjacent container.

Figure 5:
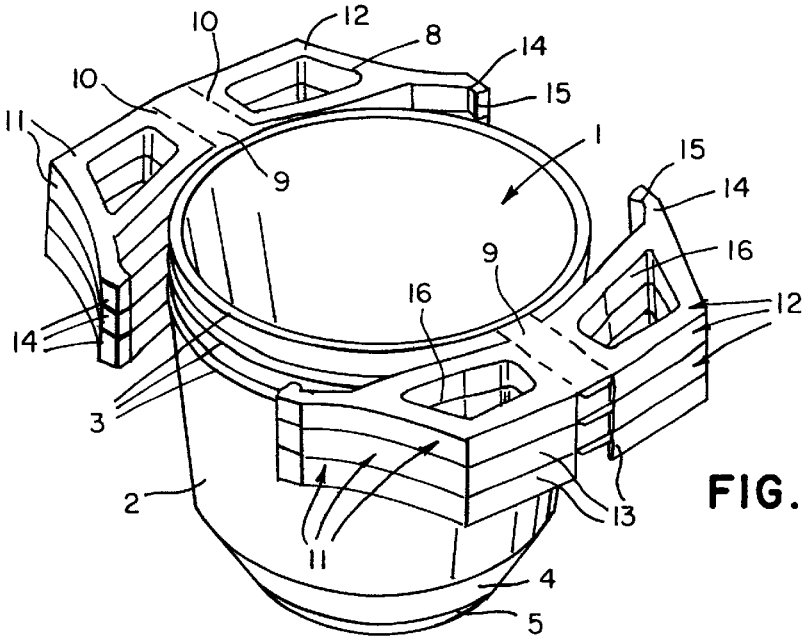
FIG. 5 is a perspective view of a stack of three nested containers each having two handles.

FIG. 5 is a similar stack of three nested containers 1 which each have two winged projections 6 extending radially from opposite sides of the upper rim 3 of the cup 2.

In the preferred construction the handle wings 12*a* and 12*b* are each moulded with walls 16 which form a hollow tubular section with a shaped aperture simulating that of a conventional cup handle. However, it will be understood that this may take the form of a rectangular, round, oval or octagonal cross-section. It is also possible to leave out the inner wall of the wing so that the handle is similar to a conventional loop handle.

The winged projection is formed integrally with the side of the cup or bowl but its strength does not rely on the distortion of the material but on the cantilever principle achieved by the lock formed between the parts 14 and 7.

Although the wings 12*a* and 12*b* are connected to the centre part 9 by the fold lines they form a permanent integral part of the container. When rotated through 90° the wings are sufficiently stable to allow torsion to exert pressure in an over centre clip at the cup base which is integral with the cup. By using the base clip, if the container is used with a hot liquid, the wings of the handle remain locked unless deliberate force is applied to unclip the base lock. The base attachment clip of the handle also provides an applied extension of the base of the container improving the stability of the cup by moving the centre of gravity to compensate for the weight of the handle.

Figure 2:
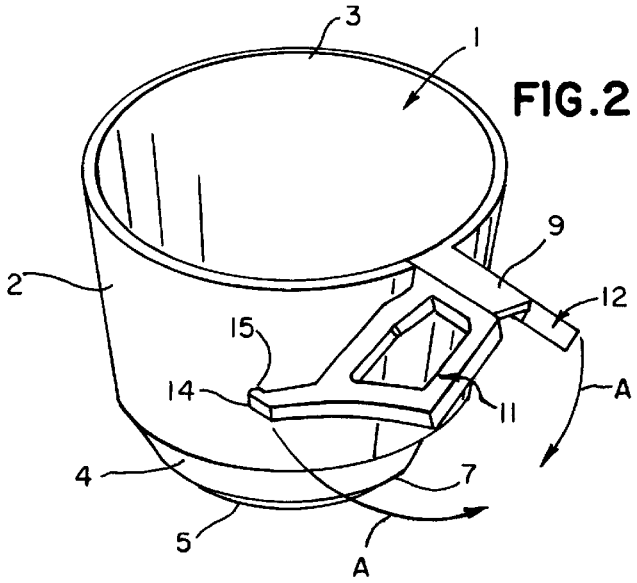
FIG. 2 is a similar view of the container to FIG. 1 with the winged projection folded downwards in the direction of the arrows.
Figure 6:
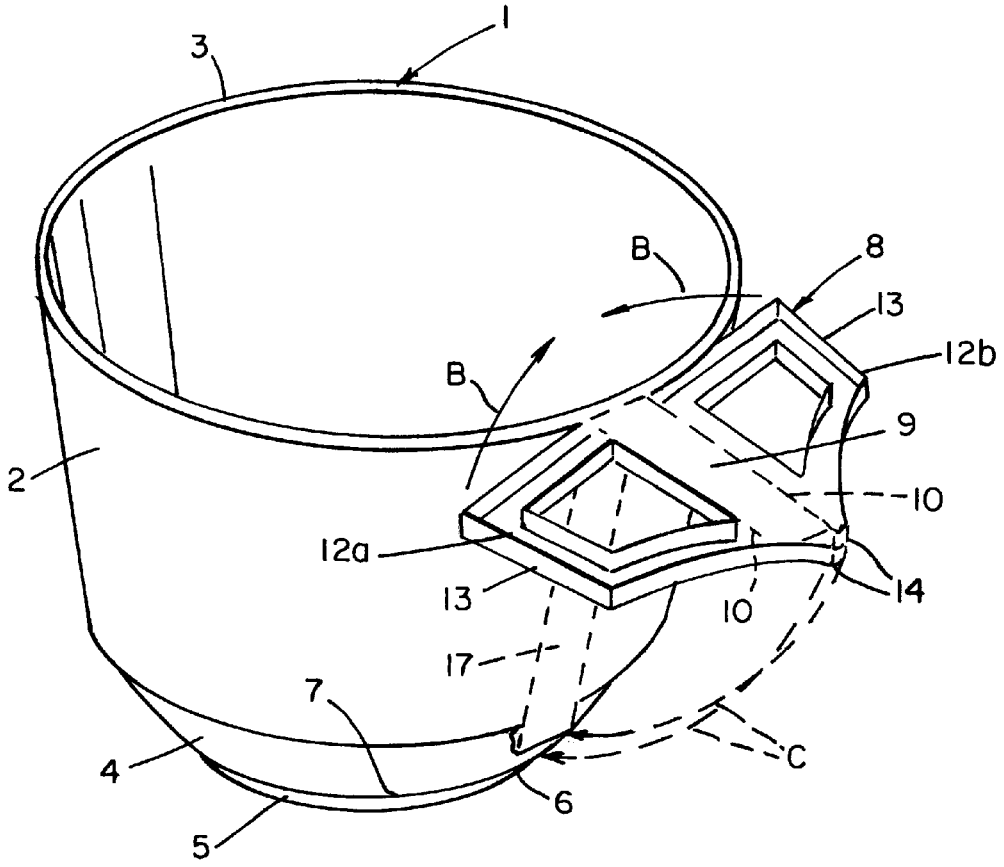
FIG. 6 is a perspective view of a second embodiment of a container with winged projections to be folded upwards.
Figure 7:
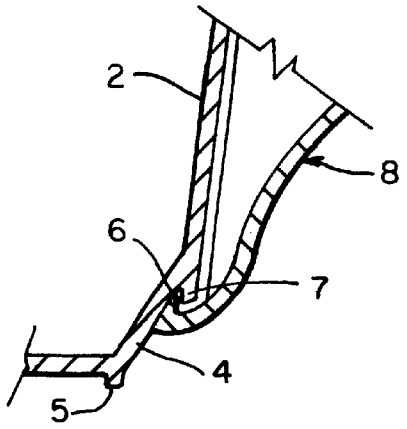
FIG. 7 is a fragmentary section of the container of FIG. 6 with the handle formed by the winged projections secured to the base of the container.

In a second embodiment of the container shown in FIGS. 6 and 7, like parts have the same reference numerals as in the embodiment of FIGS. 1 to 3.

In this second embodiment the wings 12*a* and 12*b* lie in a plane level with the upper rim 3 of the cup-shaped part 2. The wings are assembled into a handle by folding them along the fold lines 10 of the centre part 9 in an upward direction as shown by the arrows B. The assembled handle wings are pivoted downwards as shown by the dotted arrows C so that the centre part 9 engages the cup-shaped wall at 17 and the angle-shaped abutments 14 clip onto the angled edge 7 locking the wings 12*a* and 12*b* together forming a stable handle to support the cup-shaped part 2 and its contents.

Figure 8:
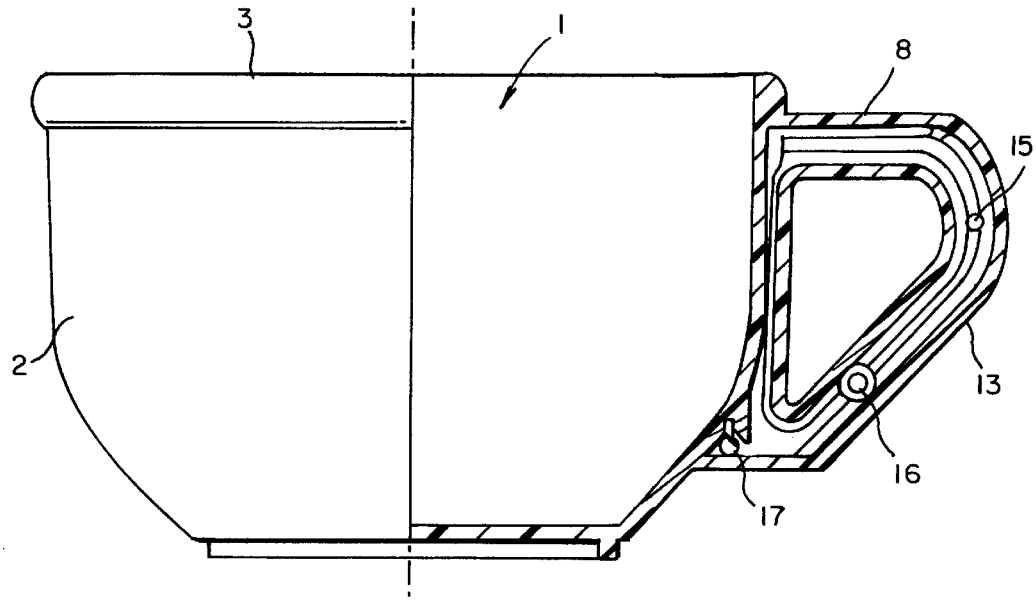
FIG. 8 is a side elevation of a modified container with locking means for the winged halves of the handle.
Figure 9A:
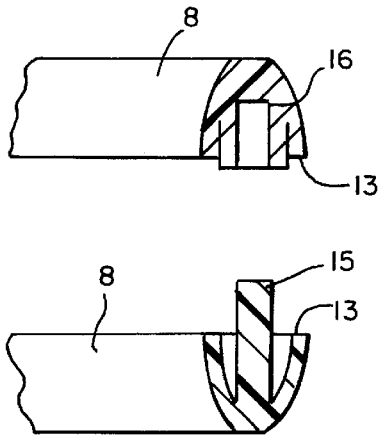
Figure 9B:
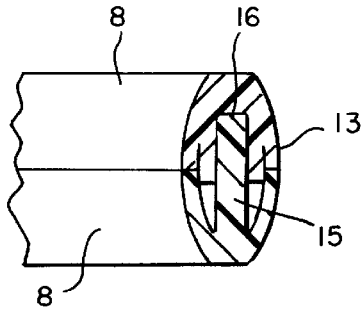
FIG. 9*b* is a sectional detail of the locking means in the locked position.

In a third embodiment of the container 1 the winged projections 8 are folded downwards so that their edge walls 13 engage and the winged projections are held together by locking means in the form of a pin 15 on one projection 8 engaging a hole 16 formed in the other projection 8. Each winged projection may have a pin 15 and a hole 16 as shown in FIG. 8. FIGS. 9*a* and 9*b* show the locking means in the open and locked positions, respectively. The pin and hole engage each other with an interference fit to provide a resilient locking of the two winged projections.

The free ends of the winged projections 8 each have a keyway 17 introduced into the base pin. This keyway 17 is modified to suit and carry a key detail providing a secure locking of the free ends of the winged projections to the base of the cup container 2.

The container of the present invention enables the stacking of the containers to conserve space and for ease of transport, reducing the space by a ratio of at least one in ten.

The moulded container is 49 to 50% lighter than conventional plastic cups at present used by airlines. As an example in the case of drinking cups used on Concorde where china cups are used, the weight reduction would be from 275 grams down to 15 grams equivalent per cup.

The containers can be manufactured by an injection moulding process which eliminates the conventional core moulding tool used at present in the making of plastic cups for airlines to reduce significantly the overall cost. Multiple impressions can be achieved simultaneously on one pair of matching die faces and thus produce them more efficiently and economically. The finished product can of course be made of white or multi-coloured plastics material with a shiny or matt surface and can be 'clinically' clean when delivered.

What is claimed is:

1. An injection molded food or drink container of plastic material comprising a cup-shaped part having a rim and a winged projection extending radially from the cup-shaped part, said winged projection comprising a central portion and two symmetrically shaped outer portions, the outer portions being foldably attached to opposing edges of the central portion such that the two outer portions may be folded towards each other, each through an angle of approximately 90° to form a handle for holding and supporting the cup-shaped part, said handle having a fixed end defined by the central portion of the winged projection and a free end opposing the fixed end and furter comprising means for locking the free end of the handle to the cup-shaped part, thereby imparting improved stability and support to the container.

2. A container as recited in claim 1, wherein the winged projection extends radially from the rim of the cup-shaped pan thereby facilitating the nesting of a plurality of such containers for more economic storage and distribution.

3. A container as recited in claim 1, wherein the cup-shaped part has two winged projections extending radially therefrom two diametrically opposing directions.

4. A container as recited in claim 1, further comprising a shoulder adjacent to or on the base of the cup-shaped part, and wherein the locking means is an angle-shaped part extending from the free end of the handle and having a series of parallel lateral grooves therein, said handle being configured to clip snugly onto, and thereby lock into position with, said shoulder.

5. A container as recited in claim 1, wherein the winged projection is configured such that the outer portions are folded in a downward direction to form the handle.

* * * * *